United States Patent [19]

Stang

[11] Patent Number: 4,858,869

[45] Date of Patent: Aug. 22, 1989

[54] CUP ATTACHMENT SYSTEM

[76] Inventor: Michael A. Stang, 26 Stockmill Rd. - Apt. F, Pikesville, Md. 21208

[21] Appl. No.: 246,781

[22] Filed: Sep. 20, 1988

[51] Int. Cl.[4] ..... A47K 1/08

[52] U.S. Cl. ..... 248/311.2; D7/70; 248/314

[58] Field of Search ..... 248/311.2, 314, 309.1, 248/318, 223.4, 224.4; D7/70; D6/535; 211/88; 220/8 SH

[56] References Cited

U.S. PATENT DOCUMENTS

| | | | |
|---|---|---|---|
| 2,698,155 | 12/1954 | Bowman | D7/70 X |
| 4,176,580 | 12/1979 | Gallegos | 248/224.1 X |
| 4,299,344 | 11/1981 | Yamashita et al. | 248/314 X |
| 4,697,780 | 10/1987 | Wenkman et al. | 248/311.2 X |
| 4,721,276 | 1/1988 | Moss | 248/311.2 |
| 4,749,112 | 6/1988 | Harper | 248/311.2 X |
| 4,779,831 | 10/1988 | Anderson | 248/311.2 |

*Primary Examiner*—Ramon O. Ramirez
*Attorney, Agent, or Firm*—Morton J. Rosenberg

[57] ABSTRACT

A releasable cup attachment system (100, 200) is provided for releasably mounting a cup to a base surface. The cup attachment system (100, 200) includes an insertion member (100, 210) fixedly coupled to an external surface portion of the cup (10), and a mounting receptacle (120, 220) having an open cavity (130, 230) for releasable coupling to the insertion member (110, 210) within the open cavity. In one embodiment, the open cavity (130) is defined between a rear wall (122) and front wall portions (124), and a pair of recessed angled end walls (126). The insertion member (110) is provided with an angular portion (114) having diverging sides (116 and 118) for capture within the open cavity (130). In an alternate embodiment, the tubular shaped insertion member (210) is provided with an axial cavity (214) for receipt of a guide member (222) extending from within the open cavity (230) of the mounting receptacle (220). The mounting receptacle (120, 220) is secured to a base surface by a double coated pressure sensitive tape (150) for fixation thereto, or coupling to a mounting hook (140) to provide releasable coupling to the base surface.

19 Claims, 4 Drawing Sheets

CUP ATTACHMENT SYSTEM

BACKGROUND OF THE INVENTION

1. Field Of The Invention

This invention directs itself to cup attachment systems for releasably capturing a cup. In particular, this invention directs itself to a cup attachment system wherein a mounting receptacle is provided with an open cavity for insertion therein of a mating element coupled to the cup. Still further, this invention directs itself to a cup attachment system which provides means to fixedly couple the mounting receptacle to a base surface, or alternately to a hook member for providing a releasable coupling to a base surface.

2. PRIOR ART

Cup attachment systems are well-known in the art. The best known prior art known to the Applicant include U.S. Pat. Nos. 4,250,601; 2,732,159; 4,721,276; 4,176,580; 3,003,733; 4,620,736; 3,802,654; 1,617,280; 3,878,589; 1,357,524; 3,570,049; 4,008,250; 2,695,152; 3,300,075; and, 4,557,452.

Some prior art systems such as shown in U.S. Pat. No. 4,250,601 provide a mounting receptacle wherein a front wall is provided with a V-shaped notch, or tapered slot which quickly narrows to facilitate retaining thin plastic sheet material. However, such systems are not readily adaptable for supporting cups to which are coupled a mating attachment member adapted to be received within an open cavity of the mounting receptacle.

In other prior art systems, such as shown in U.S. Pat. Nos. 4,088,250 and 2,732,159, there are provided mounting supports having keyways with tapered sidewalls and mating keys having flanges insertable within the keyway. While such systems provide adequate support for releasably coupling a cup to a base surface, they are not suited for fabrication from paperboard materials, and thereby not well suited for use with disposable cups. Whereas, the instant invention provides an easily manufacturable, low cost cup attachment system particularly well suited for use with disposable cups.

SUMMARY OF THE INVENTION

A releasable attachment system for releasably capturing a cup includes a mounting receptacle for releasably mounting the cup to a base surface. The mounting receptacle includes a housing having a discontinuous cross-sectional wall contour defining an axially extended open cavity having a substantially constant depth throughout the axial extension. The releasable attachment system also includes means for releasably coupling the cup to the mounting receptacle, coupled to an external surface of the cup and being insertable within the open cavity of the mounting receptacle.

DESCRIPTION OF THE PREFERRED EMBODIMENTS

Referring now to FIGS. 1-6, there is shown cup attachment system 100, 200 for releasably capturing and supporting a cup. As will be seen in following paragraphs, cup attachment system 100, 200 is specifically directed to the concept of releasably mounting a cup to a base surface to provide support therefor while the user's hands are otherwise occupied. Although not restricted to utilization with disposable cups, cup attachment 100, 200 is particularly adapted for support of beverage containers formed from waxed or plastic coated paper, as typically provided by fast food outlets. Additionally, cup attachment system 100, 200 provides a low cost, convenient and unobtrusive system for releasably mounting a cup to a base surface, such as an interior portion of a motor vehicle. Thus, cup attachment system 100, 200 can be provided to the consumer by a commercial establishment for the purpose of providing a convenient support for the beverage containers purchased and provide an inducement to make further purchases therefrom.

Figure 1:
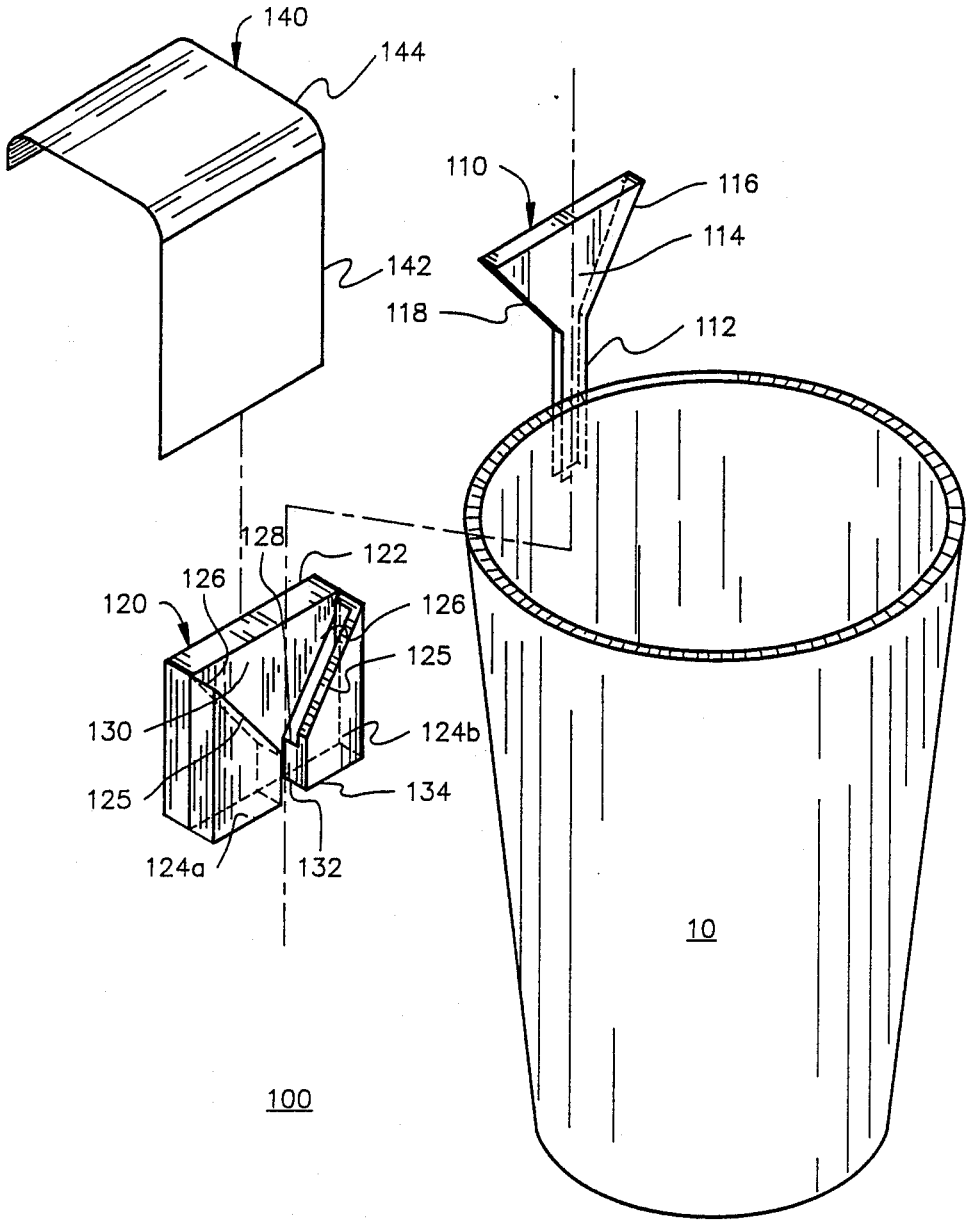
FIG. 1 is a perspective view of the cup attachment system.
Figure 3:
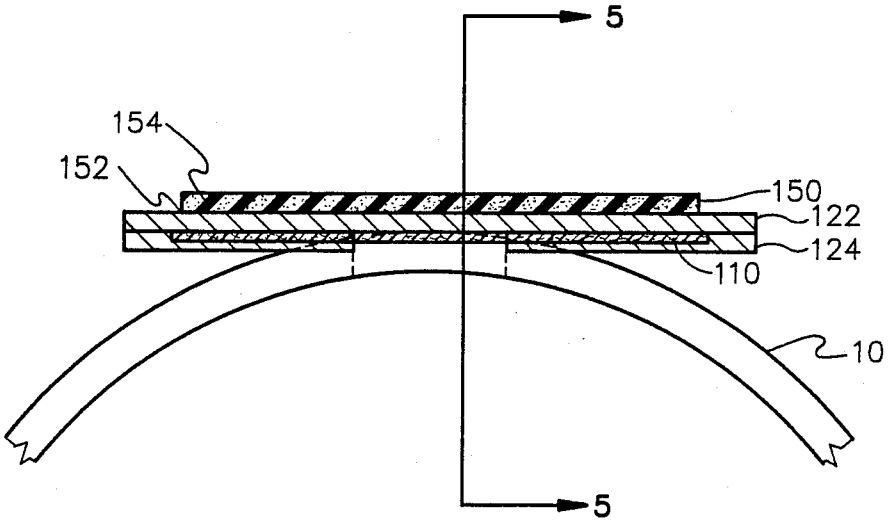
FIG. 3 is a top plan view of the cup attachment system of FIG. 1.
Figure 5:
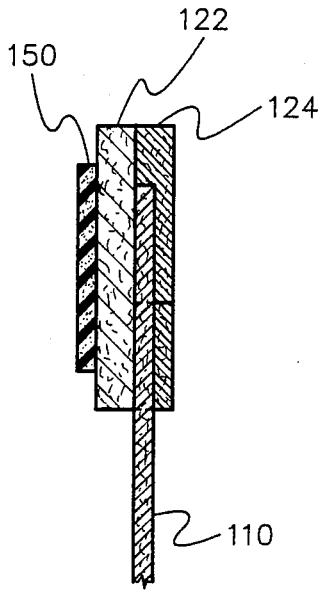
FIG. 5 is a sectional view of the cup attachment system taken along the Section Line 5—5 of FIG. 3; and, FIG. 6 is a sectional view of the cup attachment system taken along the Section Line 6—6 of FIG. 4.

Referring to FIGS. 1, 3 and 5, cup attachment system 100 includes an insertion tab 110 fixedly coupled to a cup 10 for releasable coupling to a mounting receptacle 120. As will be described in following paragraphs, mounting receptacle 120 may be fixedly coupled to a base surface or in the alternative, fixedly coupled to a mounting hook 140 for providing a releasable coupling with a base surface.

Insertion tab 110 is provided with a first portion 112 having a substantially rectangular contour, a portion of which is fixedly coupled to an external surface portion of the cup 10. The rectangular portion 112 extends from the end coupled to cup 10 to an angular portion 114. Angular portion 114 is defined by a pair of opposing sides 116 and 118 which diverge as they extend away from the rectangular portion 112. Thus, angular portion 114 has a truncated triangular contour for releasable coupling with mounting receptacle 120.

Mounting receptacle 120 is provided with an open cavity, defined by a housing having a discontinuous cross-sectional wall contour for receiving insertion tab 110 therein. Mounting receptacle housing 120 is defined by a rear wall 122 and a front wall 124 having a through opening 134 formed therein, and a pair of recessed grooves 126 forming side walls. The bottom of the open cavity 130 is provided with a slotted through opening 132. Slotted through opening 132 is centrally located at the bottom of open cavity 130 and coincident with the through opening 134 formed in front wall 124 to provide a passageway 128 in open communication with the open cavity 130 for receipt of the portion 112 of insertion tab 110.

The open cavity 130 of mounting receptacle housing 120 is thus defined by a rear wall 122, front wall 124 and inclined sidewalls 126. The dimensions of the slotted through opening 132, through opening 134 of front wall 124, the size of open cavity 130, and the angle at which sidewalls 126 are inclined have all been chosen to allow releasable capture of insertion tab 110.

The rectangular portion 112 of insertion tab 110 freely passes through the open passageway 128 defined by slotted through opening 132 and through opening 134, while the angular portion 114 easily enters the open cavity 130 and is captured therein when the opposing sidewalls 116 and 118 of tab member 110 rest against the receptacle housing sidewalls 126. Since the front wall 124 extends above the end walls 126, the insertion tab 110 is retained within the mounting receptacle 120 until the cup is lifted to remove the section 114, at least partially, from the open cavity 130. Thus, the cup 10 with its attached insertion tab 110 is displaced longitudinally and then transversely to disengage the insertion tab 110 from the mounting receptacle 120.

Mounting receptacle 120 is intended to be coupled to a base surface, thus allowing the cup 10 to be supported when not being held by the user. Although through openings may be provided for screw type fasteners the most convenient method for coupling mounting receptacle 120 to a base surface is through the use of adhesive means. As is shown in FIGS. 3 and 5, the rear surface of mounting receptacle rear wall 122 is bonded to a first surface 152 of a double backed adhesive tape 150. The opposing adhesive backed surface 154 is subsequently used to bond the mounting receptacle/adhesive tape assembly to the base surface.

Alternately, where it is desirable to have mounting receptacle 120 releasably coupled to the support structure forming the base surface for support of the cup attachment system 100, a mounting hook 140 may be provided. Mounting hook 140 is provided with a straight portion 142 for coupling to mounting receptacle rear wall 122 with the aforementioned double backed adhesive tape. Extending from the straight portion 142 is a hook portion 144 for releasably suspending mounting receptacle 120 from a support structure, such as a vehicle window ledge.

As is seen in FIGS. 1 and 3, insertion tab 110 includes a first portion fixedly coupled at one end to an external surface portion of cup 10. Insertion tab 110 may be bonded to cup 10 by any of a plurality of well-known techniques, depending upon the composition of cup 10. Insertion tab 110 may also be integrally formed on cup 10 and thereby have the same material composition. In one working embodiment, insertion tab 110 is formed from a paperboard composition and adhesively bonded to a cup having a single wall paperboard construction. In another embodiment, insertion tab 110 is integrally formed in the outer wall of a cup having a double wall paperboard construction, the outer wall having score lines for separation and unfolding of the insertion tab therefrom.

Mounting receptacle 120 is provided with an open cavity 130 for receipt of the angled portion 114 of insertion tab 110. Open cavity 130 is defined by a pair of opposing angled inclined sidewalls 126, recessed below adjacent front wall portions 124, and the back wall 122. A passage through which the rectangular portion 112 of insertion tab 110 passes is provided by a slotted through opening 132, formed in the bottom of the open cavity 130, and a coincident through opening 134 formed in front wall 124. The front facing portion of rear wall 122 and the outer surfaces of front wall portions 124 may be provided with indicia for the purpose of advertising the commercial establishment providing cup attachment system 100 to the user.

Mounting receptacle 120 may be formed from such composition as metal, plastic, or paperboard, or the like, and may be molded, cast, or machined in a one-piece formation, or in the alternative, formed by bonding multiple parts together. In one embodiment where mounting receptacle 120 is formed from paperboard, two front wall portions **124*a* and 124*b* are bonded to a back wall member 122. Each of front wall portions 124*a* and 124*b* is provided with an inclined edge having a groove 126 recessed behind a lip 125** extending the full length of the inclined edge.

The rear facing surface of mounting receptacle rear wall 122 is fixedly coupled to a support structure or in the alternative, fixedly coupled to a mounting hook 140 for releasable coupling to a support structure. In a preferred embodiment, the aforementioned coupling of mounting receptacle 120 is accomplished with a double coated pressure sensitive adhesive tape 150 having a first adhesive surface 152 bonded to rear wall 122 and a second surface 154 which may be bonded directly to the base surface forming the structural support for system 100, or to the straight portion 142 of hook 140. In one working embodiment, a double coated pressure sensitive adhesive tape having the designation PE-2132, available from Adhesives Research, Inc. of Glen Rock, Pennsylvania, has been successfully used.

The straight portion 142 of mounting hook 140 may have dimensions chosen to provide adequate space for coupling to mounting receptacle 120 and provide additional space for advertising indicia. The hook portion 144 of mounting hook 140 is dimensioned to releasably secure system 100 to such structures as vehicle window ledges, thus providing a convenient suspended support for cup 10 while the user is occupied operating the motor vehicle.

Cup attachment system 100 is particularly well suited for use in motor vehicles. In particular, the configuration of insertion top 110 and mounting receptacle 120 provides a very stable support system for cup 10. The lip and groove structure which captures the insertion tab sides 116 and 118 prevents relative displacement of the cup 10 in a front to back direction. While the portion 112 of insertion tab 110 is disposed within open passageway 128 and thereby prevented from relative displacement in a side to side direction. The system thus providing a secure support for cup 10 while the motor vehicle is in motion.

Figure 2:
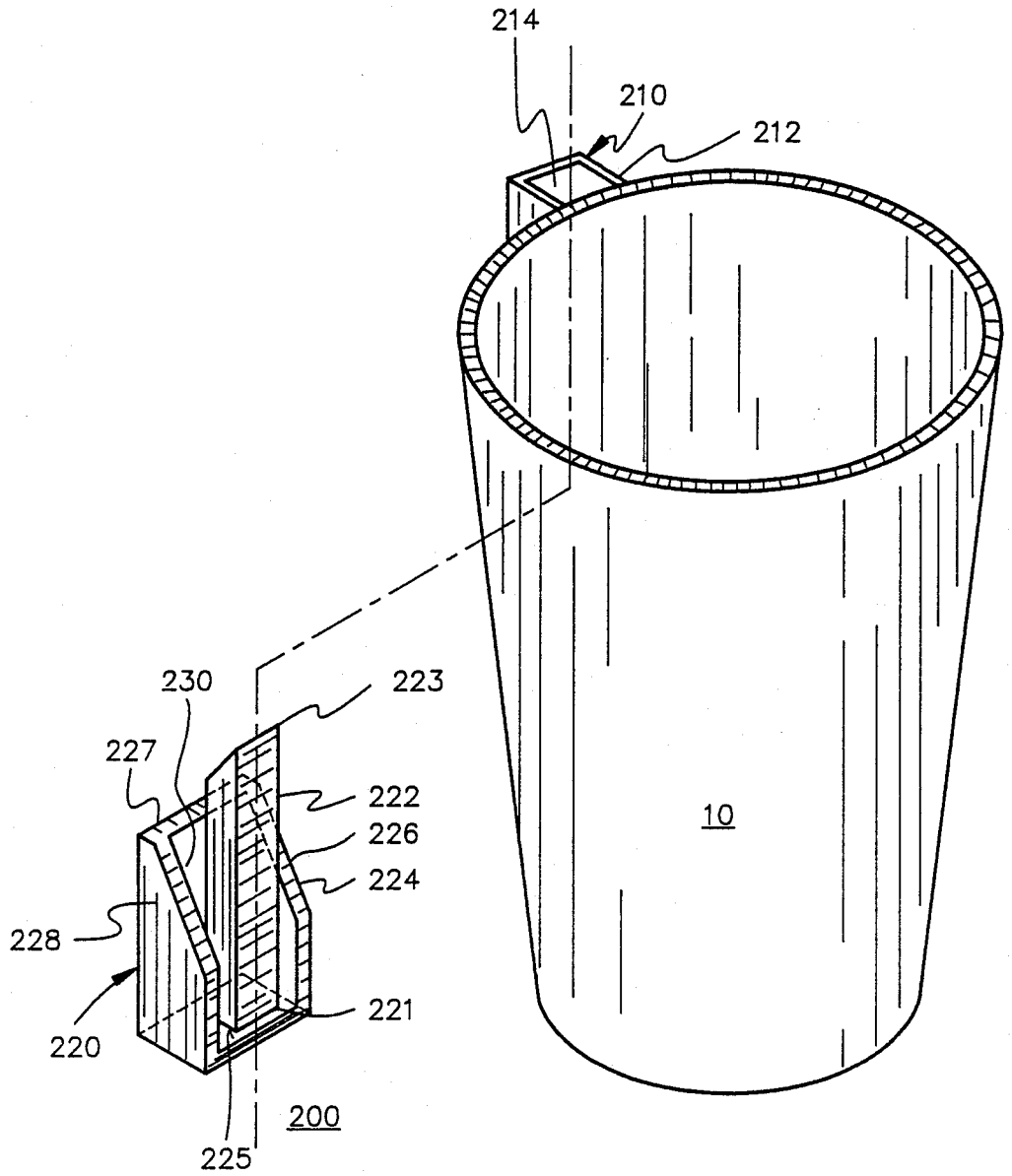
FIG. 2 is a perspective view of an alternate embodiment for the cup attachment system.
Figure 4:
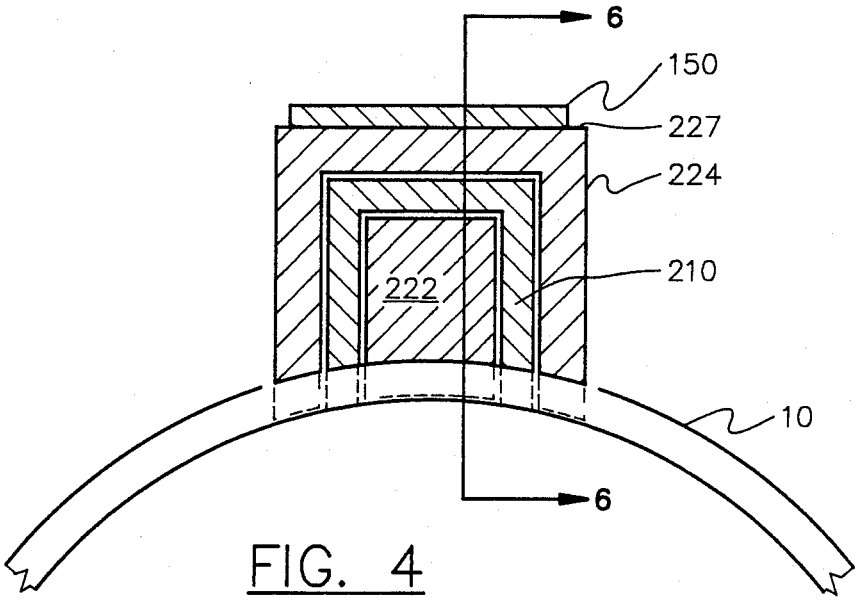
FIG. 4 is a top plan view of the cup attachment system of FIG. 2.
Figure 6:
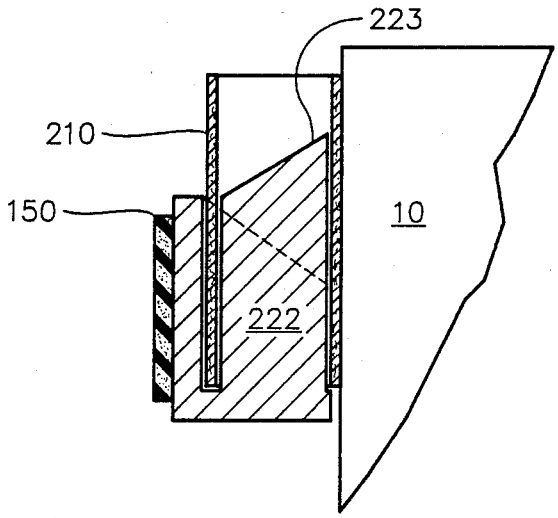

Referring now to FIGS. 2, 4 and 6, there is shown an alternate cup attachment system 200 wherein an insertion channel 210 coupled to an external surface of the cup 10 functionally replaces the insertion tab 110 of system 100. Insertion channel 210 is insertable within the open cavity 230 of mounting receptacle 220, and is retained therein by a guide member 222. The rear wall 227 of mounting receptacle 220 may be provided with a double coated pressure sensitive adhesive backed tape 150 for coupling directly to a base structure or to mounting hook 140, as has been previously described for system 100.

Insertion channel 210 is formed as a tubular structure having an outer wall 212 defining an open axial channel 214. Insertion channel 210 may be bonded to cup 10 or integrally formed thereon and comprised of a material composition substantially the same as that of cup 10.

Mounting receptacle 220 is formed by a housing having opposing sidewalls 226 and 228, rear wall 227, and bottom wall 225. The mounting receptacle housing 220 defines an open cavity 230 in which a centrally located guide member 222 is provided. Guide member 222 is centrally located on an interior surface of bottom wall 225 of housing 220 and extends longitudinally therefrom. Guide member 222 is fixedly coupled to bottom wall 225 on a first end 221, extending longitudinally beyond the housing 220 to an inclined second end 223. Second end 223 of guide member 222 is inclined downwardly toward rear wall 227 to facilitate insertion of channel 210 thereon. Thus, guide member 222 is dimensioned to be slidingly received within the open axial channel 214 of insertion channel 210. The tubular wall 212 of insertion channel 210 being captured within the intermediate space between guide member 222 and the housing walls 226, 227 and 228. Insertion channel 210 and guide member 222 may have corresponding substantially rectangular cross-sectional configurations, as shown, or any of a number of other cross-sectional configurations, such as circular, oval, or polygonal. Insertion channel 210 may be bonded to cup 10 or integrally formed thereon, and having a similar material composition, such as metal, plastic, or paperboard. Mounting receptacle 220 may be formed from a plastic composition and molded in a one-piece formation, to which the double coated pressure sensitive tape 150 can then be applied.

Cup support system 200 is also particularly well suited for use in motor vehicles. The coupling between insertion channel 210 and guide member 222 prevents relative displacement in both the front to rear, and the side to side directions. While the housing side walls 226 and 228 substantially prevent rotation of the insertion channel 210 about the guide member 222 when both have a cylindrical configuration. Non-symmetrical configurations of the insertion channel and guide member provides for prevention of rotation about the guide member. Additionally, the spacing between the housing walls and the guide member provides a tight fit for the insertion channel and thereby securely retains the channel therein, until withdrawn by the user.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A releasable attachment system for releasably capturing a cup, comprising:

receptacle means for releasably mounting said cup to a base surface, said receptacle means including a housing having a discontinuous cross-sectional wall contour defining an axially extended open cavity having a substantially constant depth throughout said axial extension; and insertion means coupled to an external surface of said cup for releasable coupling to said receptacle means within said open cavity, said insertion means including a tab member having a substantially rectangular first portion extending from a first end of said tab member to an angular second portion extending from said first portion to a second end of said tab member, said tab member first end being coupled to said external surface of said cup.

2. The releasable attachment system as recited in claim 1 wherein said angular second portion of said tab member is defined by a pair of opposing walls diverging from said rectangular first portion to said tab member second end.

3. The releasable attachment system as recited in claim 2 wherein said housing includes a front wall having a through opening formed therein for receipt of said tab member.

4. The releasable attachment system as recited in claim 3 wherein said open cavity includes a bottom portion having a centrally located slotted through opening coincident with said front wall through opening for defining a passageway in open communication with said open cavity.

5. The releasable attachment system as recited in claim 4 wherein said passageway having a predetermined transverse dimension to allow rectangular first portion of said tab member to pass therethrough.

6. The releasable attachment system as recited in claim 5 wherein said receptacle means further includes means for coupling said housing to said base surface.

7. The releasable attachment system as recited in claim 6 wherein said means for coupling includes a double backed adhesive tape having a first side coupled to an external surface of a rear wall portion of said housing and a second side coupled to said base surface.

8. The releasable attachment system as recited in claim 6 wherein said receptacle means further includes a hook member coupled to said means for coupling to provide releasable coupling to said base surface, said means for coupling including a double backed adhesive tape having a first side coupled to an external surface of a rear wall portion of said housing and a second side coupled to said hook member.

9. The releasable attachment system as recited in claim 3 wherein said tab member is integrally formed on said external surface of said cup.

10. A releasable attachment system for releasably capturing a cup, comprising:

receptacle means for releasably mounting said cup to a base surface, said receptacle means including a housing having a discontinuous cross-sectional wall contour defining an axially extended open cavity having a substantially constant depth throughout said axial extension; and, insertion means coupled to an external surface of said cup for releasable coupling to said receptacle means within said open cavity, said insertion means including a channel member fixedly coupled to said cup having a tubular contour forming an open channel axially aligned with said cup.

11. The releasable attachment system as recited in claim 10 wherein said receptacle means further includes a longitudinally extended guide member centrally located within said open cavity of said housing for insertion into said open channel of said channel member, whereby said channel member walls are releasably received within said open cavity of said housing intermediate said guide member and said housing sidewalls.

12. The releasable attachment system as recited in claim 11 wherein said guide member having a first end fixedly coupled to a bottom wall of said housing extends to an inclined second end.

13. The releasable attachment system as recited in claim 12 wherein said inclined second end inclines downwardly toward a rear wall portion of said housing.

14. The releasable attachment system as recited in claim 12 wherein said guide member having a predetermined longitudinal dimension greater than a predetermined longitudinal dimension of said housing for guiding said channel member into said open cavity of said housing.

15. The releasable attachment system as recited in claim 14 wherein said receptacle means further includes means for coupling said housing to said base surface.

16. The releasable attachment system as recited in claim 15 wherein said means for coupling includes a double backed adhesive tape having a first side coupled to an external surface of a rear wall portion of said housing and a second side coupled to said base surface.

17. The releasable attachment system as recited in claim 15 wherein said receptacle means further includes a hook member coupled to said means for coupling to provide releasable coupling to said base surface, said means for coupling including a double backed adhesive tape having a first side coupled to an external surface of a rear wall portion of said housing and a second side coupled to said hook member.

18. The releasable attachment system as recited in claim 11 wherein said guide member and said housing are integrally formed in one piece formation.

19. The releasable attachment system as recited in claim 18 wherein said one piece formation of said housing and said guide member is formed from a plastic composition.

* * * * *